US012102230B2

(12) United States Patent
Fundberg et al.

(10) Patent No.: US 12,102,230 B2
(45) Date of Patent: Oct. 1, 2024

(54) ELONGATED SUPPORT MEMBER AND A GOODS STORAGE SYSTEM

(71) Applicant: IKEA Supply AG, Pratteln (CH)

(72) Inventors: Marcus Fundberg, Älmhult (SE); Gaston Luu, Älmhult (SE)

(73) Assignee: IKEA Supply AG, Pratteln (CH)

( * ) Notice: Subject to any disclaimer, the term of this patent is extended or adjusted under 35 U.S.C. 154(b) by 136 days.

(21) Appl. No.: 17/782,190

(22) PCT Filed: Dec. 4, 2020

(86) PCT No.: PCT/SE2020/051169
§ 371 (c)(1),
(2) Date: Jun. 3, 2022

(87) PCT Pub. No.: WO2021/112752
PCT Pub. Date: Jun. 10, 2021

(65) Prior Publication Data

US 2023/0012306 A1 Jan. 12, 2023

(30) Foreign Application Priority Data

Dec. 5, 2019 (SE) ..... 1951398-5

(51) Int. Cl.
*A47B 96/06* (2006.01)
*A47B 96/02* (2006.01)

(52) U.S. Cl.
CPC ..... *A47B 96/061* (2013.01); *A47B 96/028* (2013.01)

(58) Field of Classification Search
CPC ... A47B 96/061; A47B 96/028; A47B 47/022; A47B 57/406; A47B 57/42;
(Continued)

(56) References Cited

U.S. PATENT DOCUMENTS 1,247,938 A * 11/1917 Curtenius ..... F16B 2/12 180/68.5
1,468,813 A * 9/1923 Huff ..... A47B 57/42 211/90.01
(Continued)

FOREIGN PATENT DOCUMENTS

BE 835697 A * 3/1976 ..... A47B 57/402
DE 102017112669 A1 12/2018
(Continued)

OTHER PUBLICATIONS

PCT International Search Report for PCT Application No. PCT/SE2020/051169 mailed Jan. 28, 2021 (6 pages).
(Continued)

*Primary Examiner* — Kimberly T Wood
(74) *Attorney, Agent, or Firm* — Merchant & Gould P.C.

(57) ABSTRACT

An elongated support member and a goods storage system includes an elongated support member (3, 4) including two spaced wall portions (19, 20) defining a channel (21) extending in a longitudinal direction of the elongated support member for receipt of an inner mounting end (22) of a support bracket (7, 8, 9, 10), wherein each one of the two spaced wall portions includes at least one engagement structure (23*a*, 23*b*; 24*a*, 24*b*) facing the channel for engagement with a laterally projecting engagement structure of the support bracket, wherein each one of the engagement structures (23*a*, 23*b*; 24*a*, 24*b*) has an open end facing in the same direction in the longitudinal direction of the elongated support member for receipt of an engagement structure of the support bracket during mounting of a goods storage system.

15 Claims, 9 Drawing Sheets

(58) Field of Classification Search
CPC ..... A47B 96/1408; A47B 57/48; A47B 57/52; A47B 96/06; A47B 96/14; A47B 96/1433; A47F 5/103; F16B 2200/20
USPC ..... 248/250, 235, 241, 243, 247, 218.4, 248/223.41, 248, 222.51, 222.52, 211, 248/207, 206, 191, 192, 189, 193, 204, 248/208
See application file for complete search history.

(56) References Cited

U.S. PATENT DOCUMENTS 2,103,106 A * 12/1937 Yurkovitch ..... A47B 57/42 248/223.41
2,336,604 A * 12/1943 Edward ..... A47B 57/425 211/103
2,528,807 A * 11/1950 Whitney ..... A47B 57/16 211/90.01
2,674,431 A * 4/1954 Attwood ..... A47B 57/56 248/222.12
2,741,449 A * 4/1956 Heseiov ..... A47B 57/52 248/243
2,872,144 A * 2/1959 Hobson ..... A47B 57/32 248/225.11
2,902,166 A * 9/1959 Bahr ..... F16B 5/00 211/11
2,997,269 A * 8/1961 Urbain ..... A47B 57/52 108/106
3,127,995 A * 4/1964 Mosinski ..... A47B 57/402 211/182
3,143,088 A * 8/1964 Evans ..... A47B 57/16 108/147.12
3,199,471 A * 8/1965 Orsi ..... F16B 12/50 211/187
3,217,894 A * 11/1965 Shewell ..... A47B 57/402 211/187
3,237,779 A 3/1966 Eger
3,244,290 A * 4/1966 Kaufman ..... A47B 57/50 211/189
3,422,775 A * 1/1969 Johnsson ..... A47B 57/16 108/109
3,439,812 A * 4/1969 Preston ..... F16B 12/20 403/231
3,556,306 A * 1/1971 Shell ..... A47B 96/021 211/187
3,664,627 A * 5/1972 Sykes et al. ..... A47B 57/567 248/246
3,730,468 A * 5/1973 Magnusen ..... A47B 96/1416 29/897.3
4,007,919 A * 2/1977 Totten ..... E04H 17/1413 256/65.13
4,039,131 A * 8/1977 Perrault ..... H02G 3/30 248/222.51
4,055,253 A * 10/1977 Oztekin ..... A47F 5/103 108/108
4,067,445 A * 1/1978 Derclaye ..... A47B 57/402 248/243
4,142,638 A * 3/1979 Vargo ..... A47B 57/34 211/187
4,180,003 A * 12/1979 Clement ..... A47B 57/16 108/147.15
4,201,139 A * 5/1980 Suttles ..... A47B 57/40 108/109
4,299,368 A * 11/1981 Winkler ..... A47B 57/56 248/246
4,423,978 A * 1/1984 Tiegelmann ..... A47B 57/40 403/201
4,607,576 A * 8/1986 Kranjec ..... A47B 57/16 248/188.8
4,674,723 A * 6/1987 Bayuk ..... A47B 57/56 248/246
4,711,183 A * 12/1987 Handler ..... A47B 57/402 211/187
4,821,649 A * 4/1989 Andersson ..... A47B 57/16 211/187
4,863,127 A * 9/1989 Handler ..... A47B 96/06 248/205.2
4,901,965 A * 2/1990 Bowman ..... A47B 57/56 248/246
5,265,740 A * 11/1993 Hodsden ..... A47B 57/08 211/187
5,284,311 A * 2/1994 Baer ..... A47B 57/402 403/381
5,921,411 A * 7/1999 Merl ..... A47B 96/027 211/94.01
5,930,972 A * 8/1999 Benner ..... H02B 1/01 403/14
6,085,918 A 7/2000 Puff et al.
7,690,629 B1 * 4/2010 Briggs ..... E04H 17/168 256/65.12
2005/0204966 A1 * 9/2005 Bienick ..... A47B 57/48 248/220.21
2008/0272076 A1 * 11/2008 Davenport ..... A47B 57/42 211/90.01
2015/0027972 A1 1/2015 Andersson et al.

FOREIGN PATENT DOCUMENTS

EP 0421905 A1 4/1991
EP 1665954 A1 6/2006
EP 3530146 A1 8/2019
FR 1547647 A 11/1968
FR 2747284 A1 * 10/1997 ..... A47B 47/024
GB 2048351 A 12/1980
JP 2005253690 A 9/2005
WO 2013/071977 A1 5/2013

OTHER PUBLICATIONS

PCT Written Opinion for PCT Application No. PCT/SE2020/051169 mailed Jan. 28, 2021 (6 pages).

* cited by examiner

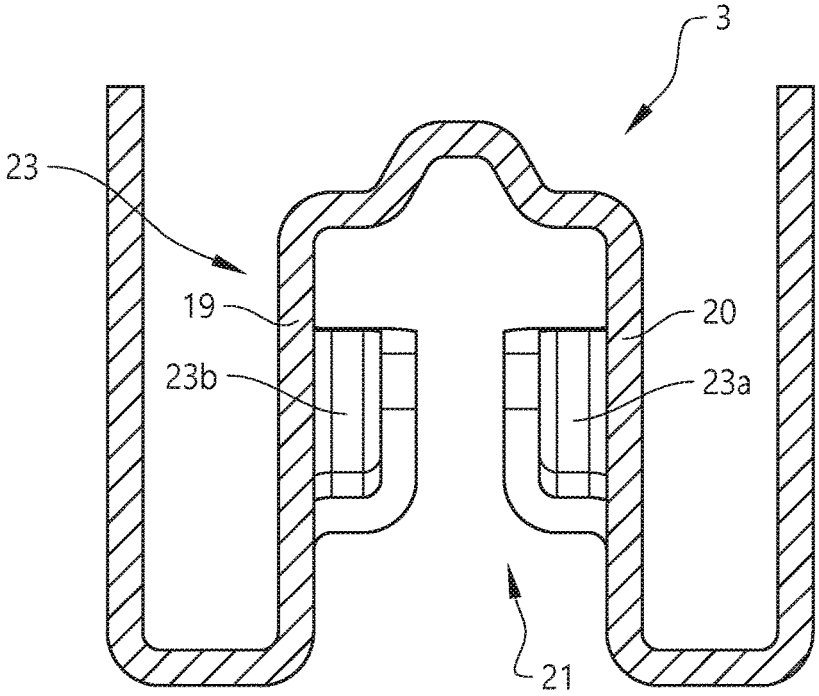
FIG. 4 A-A
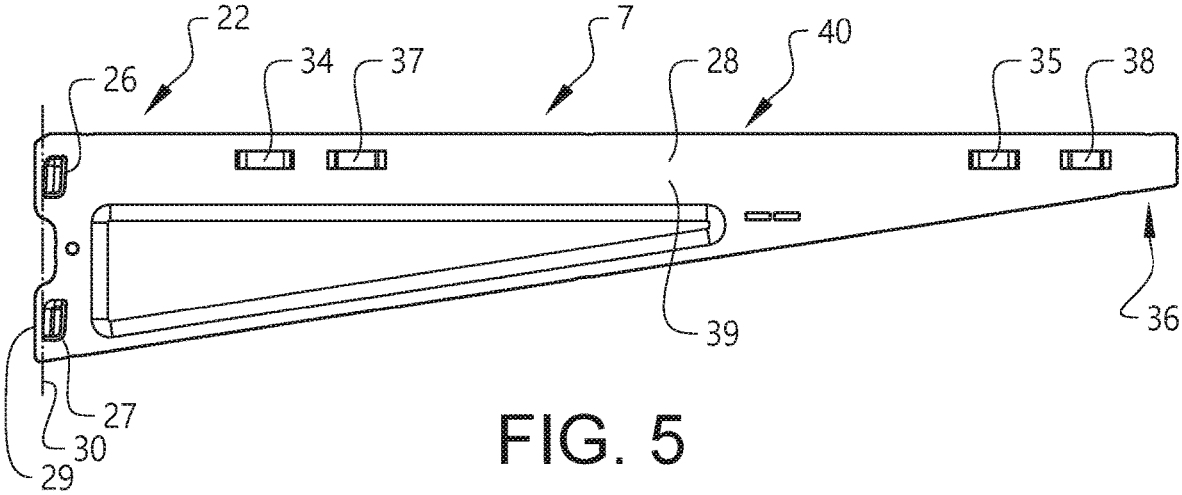
FIG. 5
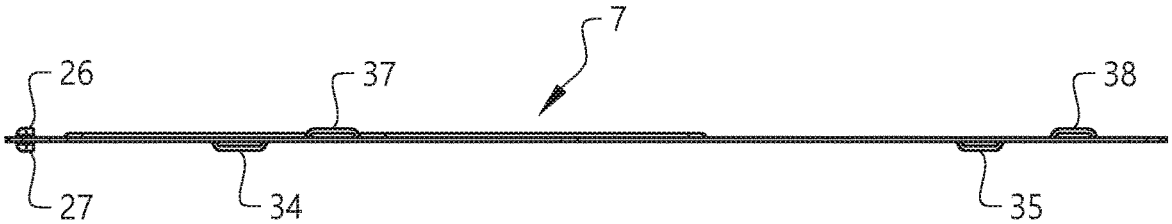
FIG. 6

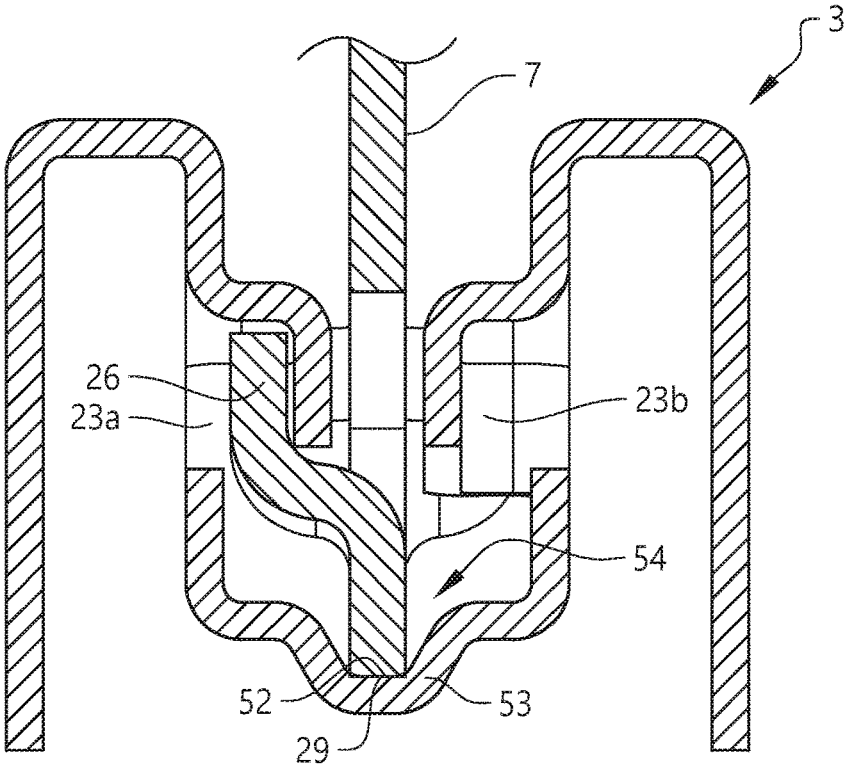
FIG. 10 C-C
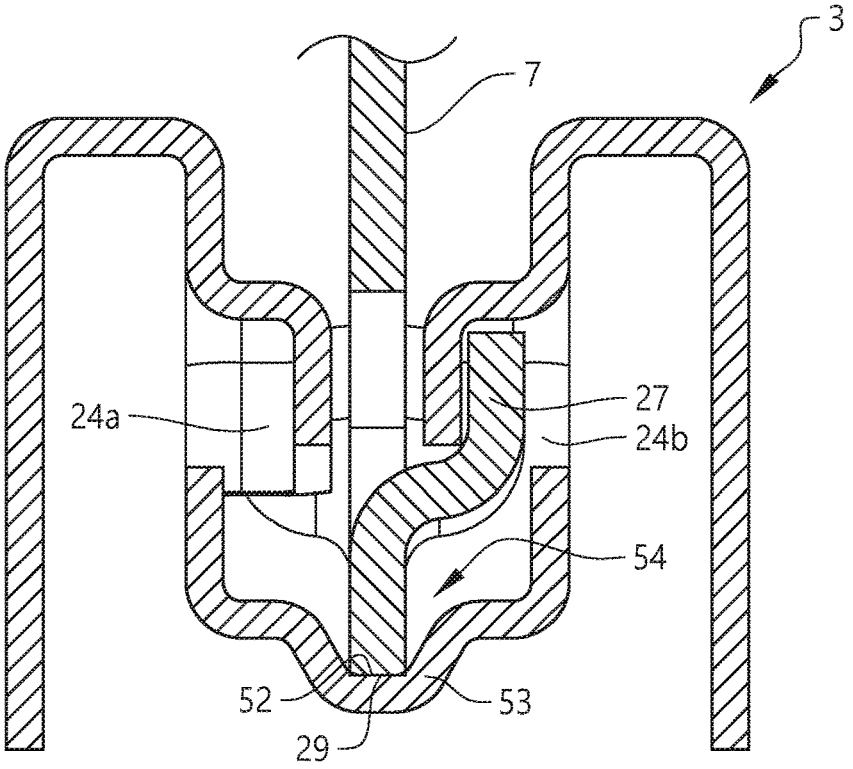
FIG. 11 B-B

ELONGATED SUPPORT MEMBER AND A GOODS STORAGE SYSTEM

This application is a National Stage Application of PCT/SE2020/051169, filed 4 Dec. 2020, which claims benefit of Serial No. 1951398-5, filed 5 Dec. 2019 in Sweden, and which applications are hereby incorporated by reference in their entireties. To the extent appropriate, a claim of priority is made to each of the above disclosed applications.

TECHNICAL FIELD

The invention relates to a goods storage system to be mounted on a wall for storing a variety of items/articles. Such a storage system comprises a pair of elongated support members, also called uprights, which are arranged in a spaced relationship to the wall such that their longitudinal direction extend in a vertical direction. The elongated support members may comprise through holes for being attached directly to the wall via fastening elements, such as screws. Alternatively, the storage system comprises an elongated crossbar for being attached to the wall via fastening elements, such as screws, with its longitudinal direction in a horizontal direction, wherein the crossbar and the elongated support members have complimentary shaped coupling means for hanging the elongated support members on the crossbar. The crossbar may alternatively be named horizontal assembly rail.

The storage system further comprises at least one pair of support brackets, one bracket being mounted on each one of the uprights and a shelf or other storage arrangement, secured to the brackets. The storage arrangement used may be adapted for storing clothes, shoes or other items, such as boxes and tools. Whilst the uprights and the brackets are generally made of metal such as steel, the shelf may be of metal, wood or similar artificial composite material. For example, the storage system may comprise two or more pair of brackets arranged in a spaced relationship in the longitudinal direction of the uprights and an equivalent number of shelves attached to the brackets one above the other with space in between the shelves. More specifically, the invention relates to such a support bracket, such an elongated support member and a goods storage system comprising the support bracket and the elongated support member.

BACKGROUND

WO 2013/071977 discloses a goods storage system comprising a crossbar, two uprights connected to the crossbar in a spaced relationship and a plurality of support brackets. Each upright is mounted to the crossbar at one end. Further, each upright has a substantially U-shaped cross section such that it defines a channel, which is open outwards for receipt of a mounting end of the bracket. More specifically, the upright comprises two spaced wall portions defining the channel. Each one of the two spaced wall portions comprises a serie of longitudinally spaced openings facing the channel for receipt of a laterally projecting engagement means of the support bracket.

Each bracket comprises two spaced side walls and two ears at the mounting end for engagement with the wall portions of the upright. More specifically, each ear forms an extension of one of the side walls of the support bracket, wherein the ear is flush with the respective side wall. Further, each ear comprises a laterally projecting engagement means at its free end for being received in one of said openings. A spacing between the ears is about the same as a spacing between the wall portions of the upright. Further, the ears are somewhat flexible in a direction towards each other for being pressed together to allow the mounting end of the bracket to be received in the channel of the upright. When the ears are released, they will flex back, wherein the laterally projecting engagement means may be received in said openings.

SUMMARY

An objective of the invention is to provide an elongated support member, which creates conditions for an improved efficiency regarding material consumption while still providing a robust construction and an easy assembly/disassembly relative to an associated support bracket for a user.

The objective is achieved by an elongated support member according to claim 1. Thus, it is achieved by an elongated support member comprising two spaced wall portions defining a channel extending in a longitudinal direction of the elongated support member for receipt of an inner mounting end of a support bracket, wherein each one of the two spaced wall portions comprises at least one engagement means facing the channel for engagement with a laterally projecting engagement means of the support bracket. The engagement means may be formed by tabs arranged for providing a space for receipt of complimentary shaped engagement means of the support bracket, wherein each one of the engagement means has an open end facing in the same direction in the longitudinal direction of the elongated support member for receipt of an engagement means of the support bracket during mounting, wherein at least one of the first engagement means and the second engagement means is formed by a portion partly cut-out and folded, and wherein at least one of the first engagement means and the second engagement means has a generally plate-shaped form.

Thus, each one of the first engagement means and the second engagement means having a generally plate-shaped form projects inwards into the channel. According to one example, at least one of the first engagement means and the second engagement means comprises a portion with a generally plate-shaped form, which portion extends in a plane substantially in parellell with an extension plane of the wall from which the engagement means extend. According to one example, the engagement means comprises a portion bridging the distance between the plate-shaped portion and the wall in a transverse direction of the elongated support member, wherein the bridging portion, the plate-shaped portion and the wall are in one piece.

The elongated support member may be designed with a relatively short distance between the two spaced wall portions defining the channel when it is adapted for supporting a single wall bracket, which creates conditions for a reduced requirement of material consumption.

According to one example, when the elongated support member is arranged in a vertical direction on the wall, the open ends will be facing upwards.

The design that at least one of the first engagement means and the second engagement means has a generally plate-shaped form creates conditions for achieving a robust design for supporting objects of high weight. The first engagement means and/or the second engagement means may be formed by a tab.

According to a further example, each one of the engagement means has a closed end facing in the same direction in the longitudinal direction of the elongated support member, which direction is opposite the direction, in which the engagement means are open. The closed end forms a stop for the associated engagement means of the support bracket during mounting. According to one example, the closed end is formed by a portion bridging the distance between the plate-shaped portion and the wall, wherein the bridging portion, the plate-shaped portion and the wall are in one piece.

According to one embodiment, two engagement means on opposite wall portions, which are adapted for engagement with two opposite laterally projecting engagement means of a single support bracket, are spaced in the longitudinal direction of the elongated support member. The spacing between the engagement means creates conditions for a robust engagement with the support bracket.

According to a further embodiment, the elongated support member comprises a plurality of pairs of engagement means, wherein each pair comprises a first engagement means on a first of said wall portions defining the channel laterally in a first direction and a second engagement means on a second of said wall portions defining the channel laterally in a second direction opposite the first direction, wherein the first engagement means and the second engagement means are arranged at the same position in the longitudinal direction of the elongated support member and wherein the pairs of engagement means are spaced in the longitudinal direction of the support member.

In other words, each wall portion is provided with a plurality of similarly shaped engagement means, which are spaced in the longitudinal direction of the elongated support member. This design provides for a flexible and esthetically attractive design in that there are multiple positions available in the longitudinal direction of the elongated support member for attachment of a bracket while the unused portions of the elongated member is symmetrical with regard to the engagement means. Further, it creates conditions for the person mounting the storage system to decide the vertical spacing between adjacent brackets.

According to a further embodiment, at least one of the engagement means defines an opening for receipt of an engagement means of the support bracket.

According to a further embodiment, at least one of the first engagement means and the second engagement means comprises an engagement portion extending at an angle relative to a longitudinal direction of the elongated support member for achieving a wedging function during mounting of the support bracket. Such a design provides conditions for an easy mounting of the bracket, wherein it guides the bracket towards the elongated support member during mounting. In this way, the bracket and the elongated support member may be arranged in fixed relationship contacting each other, or at least in a close relationship, for a robust connection.

According to a further embodiment, at least one of the first engagement means and the second engagement means is formed in one piece with the wall portion. This embodiment creates conditions for an effective manufacturing of the elongated support member in that the engagement means may be cut and folded/bent from a single sheet, which is adapted to form the elongated support member. According to one example, the engagement means may be formed by a portion of the single sheet shaped by a pressing tool.

According to a further embodiment, at least one of the first engagement means and the second engagement means is formed by a portion partly cut-out from the sheet. According to one example, a cut may be performed throughout a thickness of the sheet followed by a folding/bending action of a section of the sheet adjacent the cut. The cut may for example have the shape of an L or U.

According to a further embodiment, the elongated support member has a U-shaped cross section comprising a central portion, wherein the two wall portions extend from each end of the central portion and wherein the central portion defines a valley for receipt of an edge of the support bracket. The valley is dimensioned for supporting the bracket on either side in the mounted state.

A further objective of the invention is to provide a goods storage system, which creates conditions for an improved efficiency regarding material consumption while still providing a robust construction and an easy assembly/disassembly by a user.

The objective is achieved by a goods storage system according to claim 6. Thus, it is achieved by a goods storage system comprising at least one elongated support member according to any one of the designs and embodiments described above for being arranged against a wall with its longitudinal direction in a vertical direction and at least one bracket, wherein the bracket comprises a mounting end for being mounted to an elongated support member, wherein the bracket comprises a plate-shaped element with a first engagement means projecting laterally in a first direction from the plate-shaped element and a second engagement means projecting laterally in a second direction from the plate-shaped element opposite the first direction, wherein the first engagement means and the second engagement means are positioned at the mounting end of the bracket for engagement with the elongated support member, wherein the bracket is mountable to the elongated support member by means of the laterally projecting engagement means of the bracket being engaged with the two engagement means in the two spaced wall portions of the elongated support member.

More specifically, the bracket may be of a single-wall type, which creates conditions for an improved efficiency regarding material consumption. Further, a bracket of single-wall type creates conditions for a large support area for goods in that the bracket may have a small crosswise dimension and a shelf, or other storing arrangement, may have a large length as it is positioned between and attached to two such brackets.

Further, in an embodiment with at least three uprights, two adjacent shelves on opposite sides of a central bracket may be positioned at a small distance from each other forming an almost seamless design. Such a solution provides for an esthetically attractive appearance in that the bracket separating two such shelves has a small crosswise dimension.

The plate-shaped element may be provided with a first main surface and a second main surface opposite the first main surface, wherein the first engagement projection laterally projecting from the first main surface and the second engagement projection laterally projecting from the second main surface.

According to one embodiment, at least one of the first engagement means and the second engagement means is formed in one piece with the plate-shaped element. This embodiment creates conditions for an effective manufacturing of the bracket in that the engagement means may be cut and folded/bent in opposite directions from a single sheet, which is adapted to form the plate-shaped element. According to one example, the engagement means may be formed by a portion of the plate-shaped element shaped by a pressing tool.

According to a further embodiment, at least one of the first engagement means and the second engagement means is formed by a portion partly cut-out from the plate-shaped element. According to one example, a cut may be performed throughout a thickness of the plate-shaped element followed by a folding/bending action of a section of the plate-shaped element adjacent the cut. The cut may for example have the shape of an L or U.

According to a further embodiment, at least one of the first engagement means and the second engagement means has a generally plate-shaped form. It creates conditions for achieving a robust design for supporting objects of high weight. The first engagement means and/or the second engagement means may be formed by a tab.

According to a further embodiment, the plate-shaped element comprises an edge that defines opposite main surfaces of the plate-shaped element, wherein the edge is located at the mounting end for facing the elongated support member, wherein the edge defines an extension direction and wherein the first engagement means and the second engagement means are spaced from each other in the extension direction of the edge. The spacing between the engagement means creates conditions for a robust engagement with the elongated support member.

According to a further embodiment, the first engagement means and the second engagement means are spaced from the edge in a direction perpendicular to the extension direction of the edge. Thus, a section of the plate-shaped element adjacent the edge may be free from engagement means. More specifically, a section of the plate-shaped element adjacent the edge may be continuous along the edge. This section of the plate-shaped element adjacent the edge may be designed for contacting the elongated support member in a way providing support when the bracket is attached to the elongated support member. For example, the engagement means may be formed by partly cut-out and folded portions spaced from the edge.

According to a further embodiment, at least one of the first engagement means and the second engagement means comprises an engagement portion extending at an angle relative to the extension direction of the edge for achieving a wedging function during mounting. Such a design provides conditions for an easy mounting of the bracket, wherein it guides the bracket towards the elongated support member during mounting. In this way, the bracket and the elongated support member may be arranged in fixed relationship contacting each other, or at least in a close relationship, for a robust connection.

According to a further embodiment, the bracket comprises means for supporting a storing arrangement, wherein the storing arrangement supporting means is projecting laterally from the plate-shaped element. The storing arrangement supporting means may be formed in one piece with the plate-shaped element. According to one example, the storing arrangement supporting means may be formed by a portion of the plate-shaped element shaped by a pressing tool. According to a further development of this embodiment, the bracket extends between the mounting end and a free end and wherein the storing arrangement supporting means comprises a first set of at least two projections spaced in the bracket extension direction and projecting in the same direction from the bracket for supporting a first storing arrangement. It provides conditions for a robust connection between the storing arrangement and the bracket.

According to a further development of the last-mentioned embodiment, the storing arrangement supporting means comprises a first engagement structure projecting in a first direction from the bracket for supporting a first storing arrangement and a second engagement structure projecting from the bracket in an opposite direction relative to the first engagement structure for supporting a second storing arrangement. This embodiment creates conditions for a space-efficient solution in that the bracket having a single wall construction occupies a small distance between two adjacent storing arrangements on opposite sides of the bracket.

According to one example, the storing arrangement supporting means comprises a second set of at least two projections spaced in the bracket extension direction, which are projecting in the same direction from the bracket and in an opposite direction relative to the first set of projections for supporting a second storing arrangement.

According to one embodiment, the system comprises an elongated crossbar for being fixedly arranged against the wall with its longitudinal direction in a horizontal direction and wherein the crossbar and the elongated support member has complimentary shaped coupling means for hanging the elongated support member on the crossbar.

According to a further embodiment, the system comprises a plurality of goods storage arrangements of different design for different purposes, which have similar connection means wherein any one of the goods storage arrangements may be connected to a pair of support brackets so that different storage combinations may be achieved.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings:

FIG. 4 is a cross section view of the elongated support member according to FIG. 3, FIG. 5 is a side view of a support bracket of the goods storage system according to the first embodiment, FIG. 6 is a cross section view of the elongated support member according to FIG. 5, FIGS. 10 and 11 are two cross sectional views of the support bracket and the elongated support member according to FIG. 9, FIG. 12-14 are perspective views of different stages of an assembly procedure for mounting a storing arrangement to the support brackets according to the first embodiment.

DETAILED DESCRIPTION OF EXAMPLE EMBODIMENTS

Figure 1:
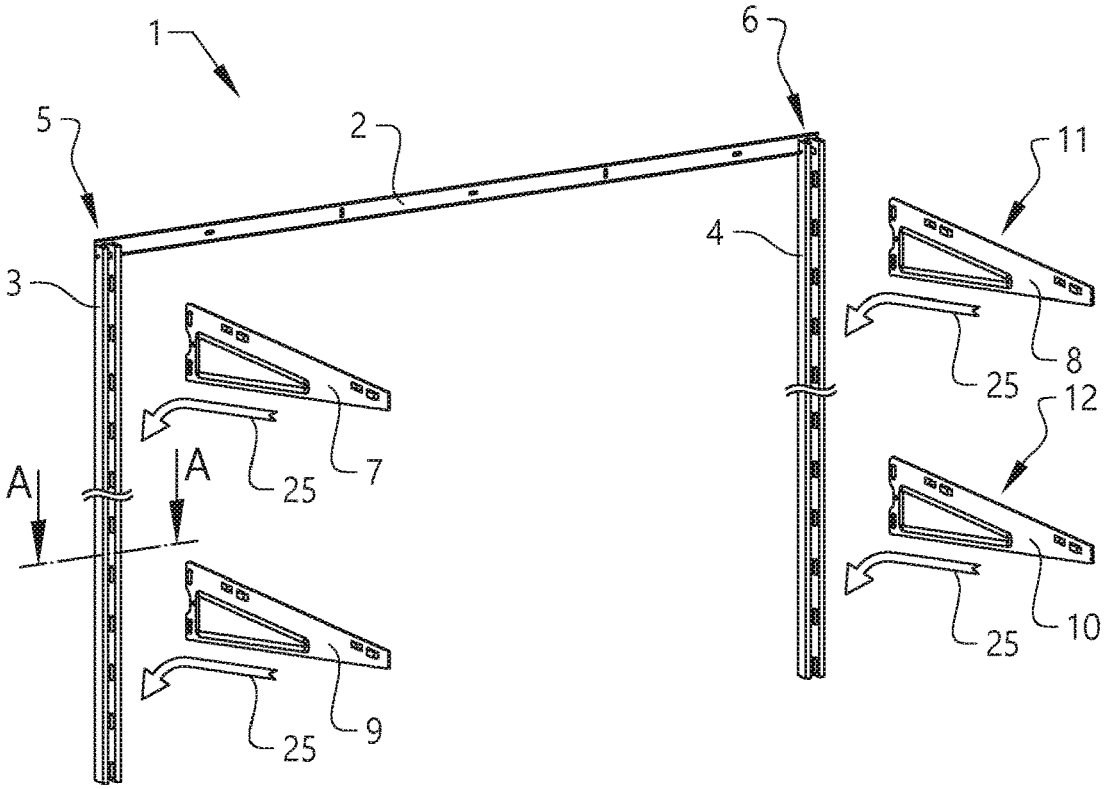
FIG. 1 is a perspective view of parts of a goods storage system according to a first embodiment.

FIG. 1 is a perspective view of parts of a goods storage system 1 according to a first embodiment. The goods storage system 1 is adapted to be mounted on a wall. The goods storage system 1 comprises a cross bar 2, which is intended to be attached to the wall in such a way that its longitudinal direction extends horizontally. The cross bar 2 may alternatively be termed assembly rail. The goods storage system 1 further comprises two horizontally spaced elongated support members 3,4. The elongated support member may alternatively be called upright or carrier rail or track. Each one of the elongated support members 3,4 is connected to the cross bar 2 at a first end 5,6 in a way that it hangs with its longitudinal direction extending vertically. More specifically, each elongated support member 3,4 is connected to the cross bar 2 in a way making it possible to slide the elongated support member 3,4 along the cross bar 2 to a desired position.

The goods storage system 1 further comprises a plurality of support brackets 7,8,9,10, which are mounted to the elongated support members 3,4. More specifically, the goods storage system 1 comprises two pairs 11,12 of brackets. A first bracket pair 11 comprises a first bracket 7 for being mounted on a first one 3 of said elongated support members and a second bracket 8 for being mounted on a second one 4 of said elongated support members at the same vertical height as the first bracket. In a similar manner, a second bracket pair 12 comprises a first bracket 9 for being mounted on the first elongated support member 3 and a second bracket 10 for being mounted on the second elongated support member 4 at the same vertical height as the first bracket. The second bracket pair 12 is spaced from the first bracket pair 11.

The support brackets 7,8,9,10 are identical. Each pair 11,12 of brackets is adapted to support a storing arrangement, such as a shelf. The brackets are adapted to project substantially perpendicularly from the wall in the mounted state. The arrows 25 indicate a mounting direction. The goods storage system 1 forms an adjustable system in that the brackets may be positioned and attached to the elongated support members in multiple different vertical positions. Further, the brackets 7,8,9,10 are adapted to be readily attachable and detachable to and from the elongated support members 3,4.

Figure 2:
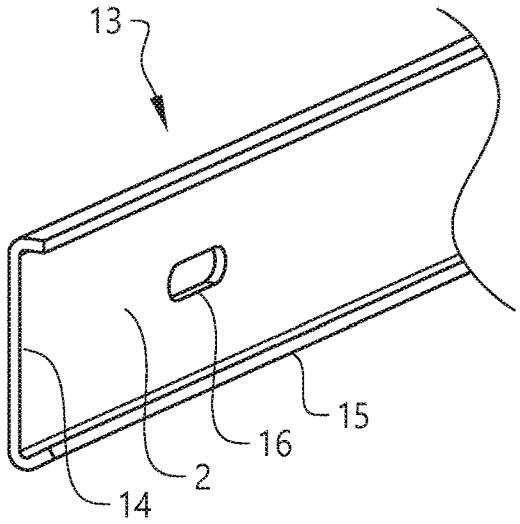
FIG. 2 is a perspective view of an end section of an elongated crossbar of the goods storage system according to the first embodiment.

FIG. 2 is a perspective view of an end section 13 of the crossbar 2. The cross bar 2 comprises a plate-shaped base portion 14, which is adapted to be arranged against the wall. The cross bar 2 further comprises a hook portion 15, which projects from a lower end of the plate-shaped base portion 14. The hook portion 15 is formed in one-piece with the plate-shaped base portion 14. More specifically, the hook portion 15 forms an upwardly angled lip. The cross bar 2 is provided with the same cross sectional shape and dimension along the complete length of the crossbar. The cross bar 2 further comprises a plurality of spaced through holes 16 in a longitudinal direction of the cross bar 2. The through holes 16 are arranged through the plate-shaped base portion 14 and are adapted for receipt of fasteners for attaching the cross bar to the wall.

Figure 3:
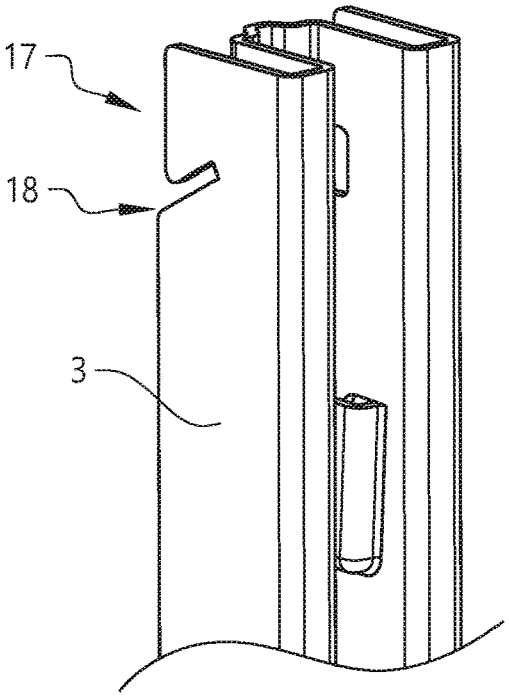
FIG. 3 is a perspective view of an end section of an elongated support member of the goods storage system according to the first embodiment.

FIG. 3 is a perspective view of an end section 17 of the elongated support member 3. The elongated support member 3 comprises means 18 for mounting the elongated support member 3 against the wall. The mounting means 18 comprises an angled slot with a complimentary design relative to the hook portion 15 of the cross bar 2 for receiving the hook portion 15. The angled slot 18 is cut into the material of the elongated support member 3 at an upper end. Thus, in a mounting operation, in a first step, the cross bar 2 is attached to the wall via fasteners so that the cross bar 2 extends horizontally. In a second step, the elongated support members 3,4 are hanged onto the cross bar 2 in a way that the hook portion 15 is received in the slot 18.

FIG. 4 is a cross section view of the elongated support member 3 at a section A-A in FIG. 1. The elongated support member 3 comprises two spaced wall portions 19,20 defining a channel 21 extending in a longitudinal direction of the elongated support member 3 for receipt of an inner mounting end 22 of the support bracket 7, see also FIG. 5. More specifically, the elongated support member has a partly U-shaped cross section comprising a central portion 53, wherein the two wall portions 19,20 extend from each end of the central portion. Each one of the two spaced wall portions 19,20 comprises at least one engagement means 23*a*,24*b*, see also FIG. 8, facing the channel for receipt of a laterally projecting engagement means 26,27 of the support bracket. Two engagement means 23*a*, 24*b* on opposite wall portions 19,20, which are adapted for receipt of two opposite laterally projecting engagement means 26,27 of a single support bracket 7, are spaced in the longitudinal direction of the elongated support member 3.

More specifically, the elongated support member 3 comprises a plurality of pairs of engagement means, wherein each pair comprises a first engagement means 23*a*, 24*a* on a first of said wall portions 19 defining the channel 21 laterally in a first direction and a second engagement means 23*b*, 24*b* on a second of said wall portions 20 defining the channel 21 laterally in a second direction opposite the first direction, wherein the first engagement means 23*a*, 24*a* and the second engagement means 23*b*, 24*b* are arranged at the same position in the longitudinal direction of the elongated support member 3 and wherein the pairs of engagement means are spaced in the longitudinal direction of the support member 3. The two elongated support members 3,4 are identical.

FIG. 5 is a side view of the support bracket 7 and FIG. 6 is a top view of the support bracket 7. The support bracket 7 comprises the mounting end 22 as mentioned above for being mounted to the elongated support member 3. The bracket 7 has a tapering shape from the mounting end 22 to a free end. The bracket 7 generally defines a right-angled triangular shape.

Further, the support bracket 7 comprises a plate-shaped element 28 with the first engagement means 26 projecting laterally in a first direction from the plate-shaped element 28 and the second engagement means 27 projecting laterally in a second direction from the plate-shaped element 28 opposite the first direction, wherein the first engagement means 27 and the second engagement means 28 are positioned at the mounting end 22 of the bracket 7 for being received in the two opposite engagement means 23*a*, 24*b* in the elongated support member 3. Both the first engagement means 26 and the second engagement means 28 is formed in one piece with the plate-shaped element 28. More specifically, each one of the first engagement means 26 and the second engagement means 27 is formed by a portion cut-out from the plate-shaped element 7 and bent/folded to a desired shape. More specifically, the first engagement means 26 and the second engagement means 27 form retention hooks. The bracket 7 may be a stamped metal component.

The plate-shaped element 28 comprises an edge 29 at the mounting end 22 for facing the elongated support member 3, wherein the edge 29 defines an extension direction 30 and wherein the first engagement means 26 and the second engagement means 27 are spaced from each other in the extension direction 30 of the edge.

The support bracket 7 further comprises means 34,35 for supporting a storing arrangement on a first side of the bracket 7. The storing arrangement supporting means 34,35 project laterally from the plate-shaped element. The bracket 7 extends between the mounting end 22 and a free end 36 and the storing arrangement supporting means 34,35 comprises two projections spaced in the bracket extension direction and projecting in the same direction from the bracket 7. More specifically, the storing arrangement supporting means 34,35 defines an opening for receipt of a complimentary shaped engagement member of the storing arrangement.

More specifically, the storing arrangement supporting means comprises a first set of at least two projections 34,35 projecting in the same direction from the bracket for supporting a first storing arrangement. Further, the storing arrangement supporting means comprises a second set of at least two projections 37,38 spaced in the bracket extension direction, which are projecting in the same direction from the bracket and in an opposite direction relative to the first set of projections 34,35 for supporting a second storing arrangement.

Figure 7:
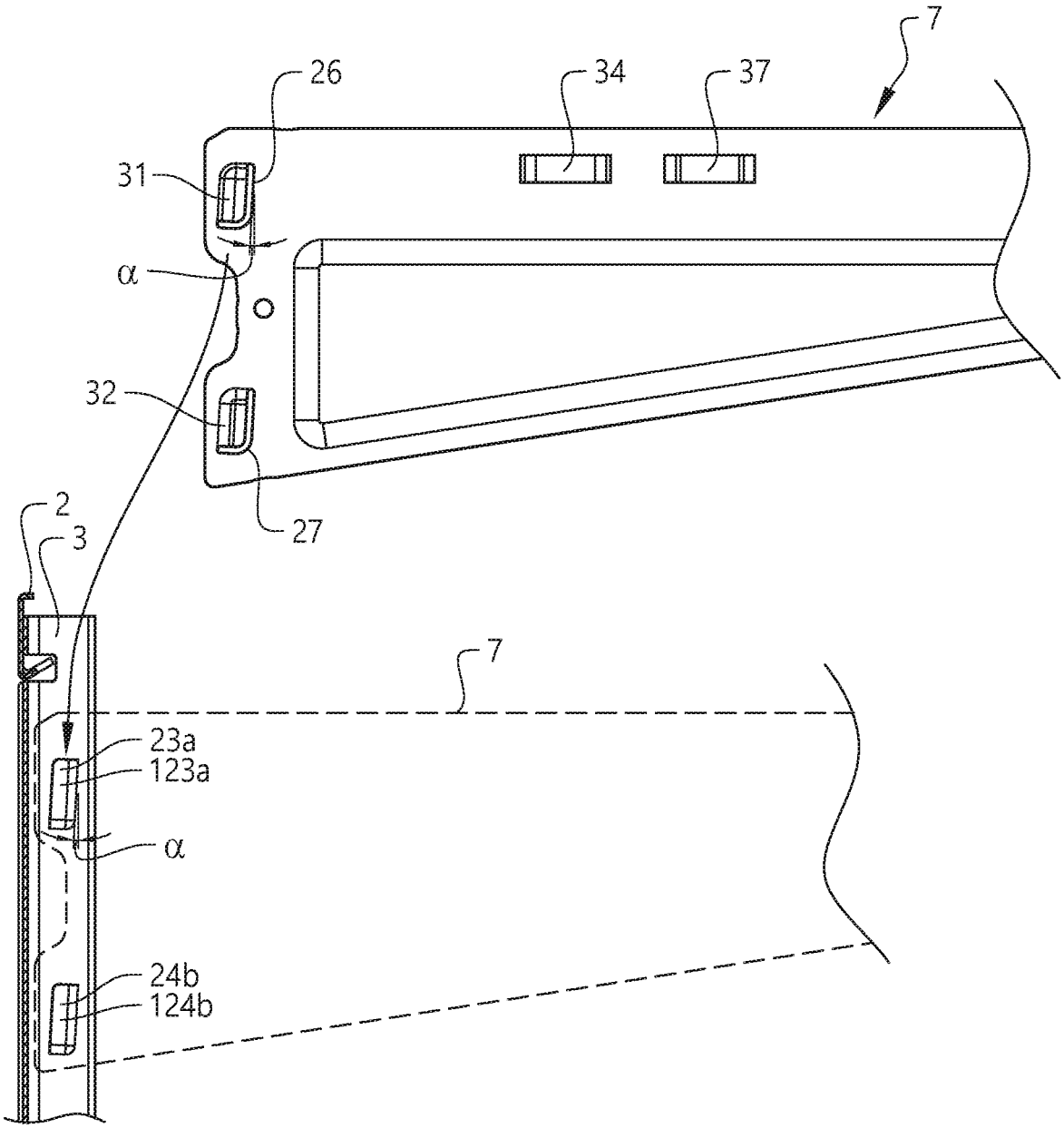
FIG. 7 is a side view illustrating parts of the support bracket and the elongated support member according to FIG. 1 during a mounting procedure.
Figure 8:
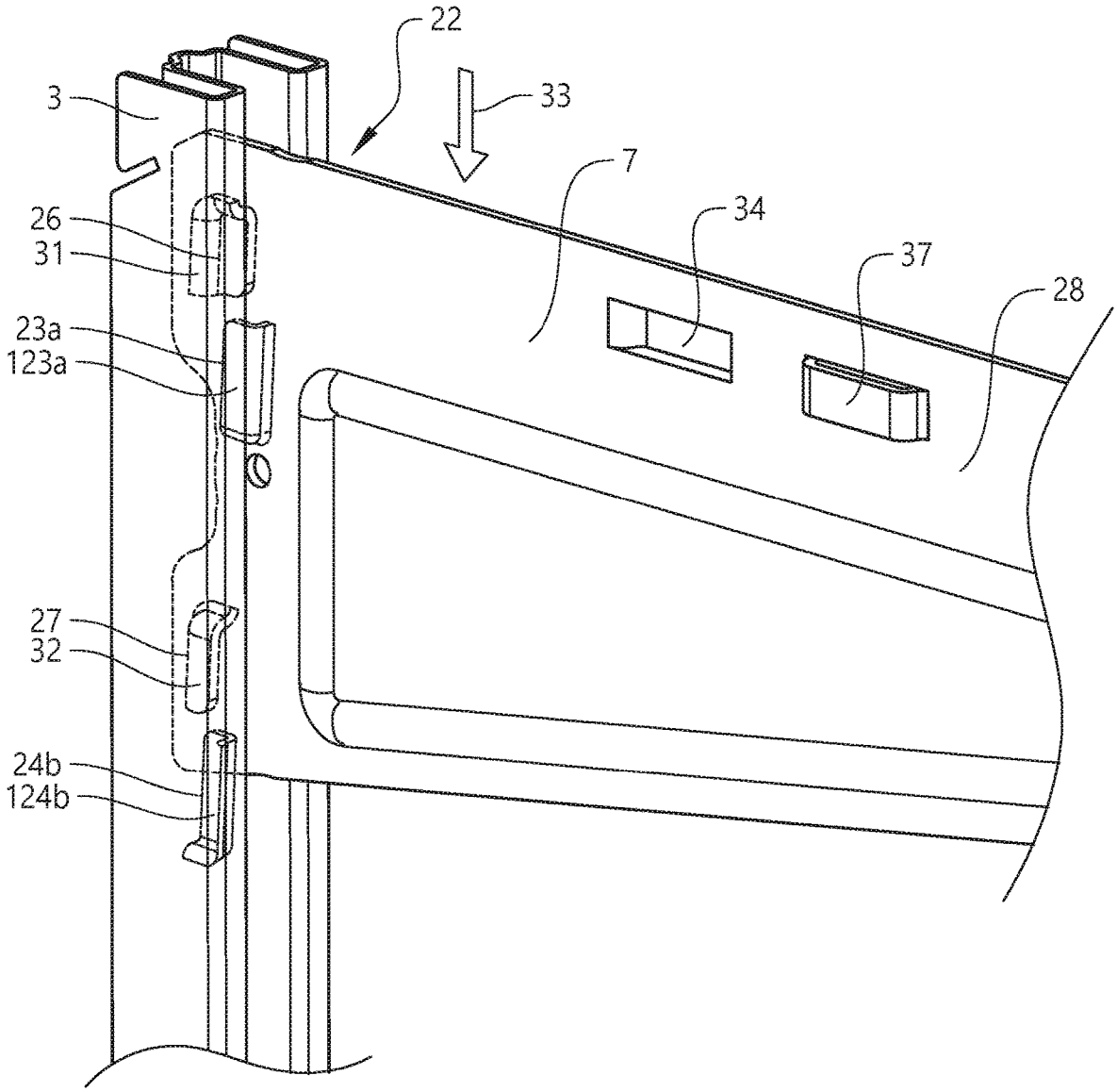
FIG. 8 is a perspective view of a mounting end of the support bracket and an associated part of the elongated support member according to FIG. 7.

FIG. 7 is a side view illustrating parts of the support bracket 7 and the elongated support member 3 during a mounting procedure. It is also referred to FIG. 8, showing a perspective view of a mounting end of the support bracket 7 and an associated part of the elongated support member 3 during mounting. Each one of the first engagement means 26 and the second engagement means 27 comprises an engagement portion 31,32 extending at an angle α relative to the extension direction 30 of the edge 29 for achieving a wedging function relative to its associated engagement means 23*a*, 24*b* of the elongated support member 3 during mounting. Each one of the engagement portions 31,32 extends at an angle α of 1-10 degrees, preferable between 2-5 degrees and especially about 3 degrees relative to the extension direction 30 of the edge 29. Each one of the engagement portions 31,32 is formed by a plate-shaped portion that has been cut and pressed out from the body of the plate-shaped element 28. At least one section of the respective plate-shaped portion is arranged with the angular relationship relative to the extension direction 30 of the edge 29.

In a similar manner as has been described above for the bracket, at least one of the first engagement means 23*a*, 24*a* and the second engagement means 23*b*, 24*b* of the elongated support member 3 comprises an engagement portion 123*a*, 124*b* extending at an angle α relative to a longitudinal direction of the elongated support member 3. The engagement portions 123*a*, 124*b* are adapted to receive and engage with the engagement portions 31,32 of the bracket 7 for guiding the bracket to its desired position relative to the elongated support member 3 during mounting.

Each one of the engagement portions 123*a*, 124*b* extends at an angle α of 1-10 degrees, preferable between 2-5 degrees and especially about 3 degrees relative to the extension direction of the elongated support member 3. Each one of the engagement portions 123*a*, 124*b* is formed by a plate-shaped portion that has been cut and pressed out from the body of the elongated support member 3. At least one section of the respective plate-shaped portion is arranged with the angular relationship relative to the extension direction of the elongated support member 3.

Further, each one of the engagement means 23*a*,23*b*; 24*a*,24*b* has an open end facing in the same direction in the longitudinal direction of the elongated support member for receipt of the complimentary shaped engagement means 26, 27 of the support bracket 7 during mounting. More specifically, at least one of the engagement means 23*a*,23*b*; 24*a*, 24*b* defines an opening for receipt of the engagement means 26,27 of the support bracket 7. The arrow 33 indicate a mounting direction.

Figure 9:
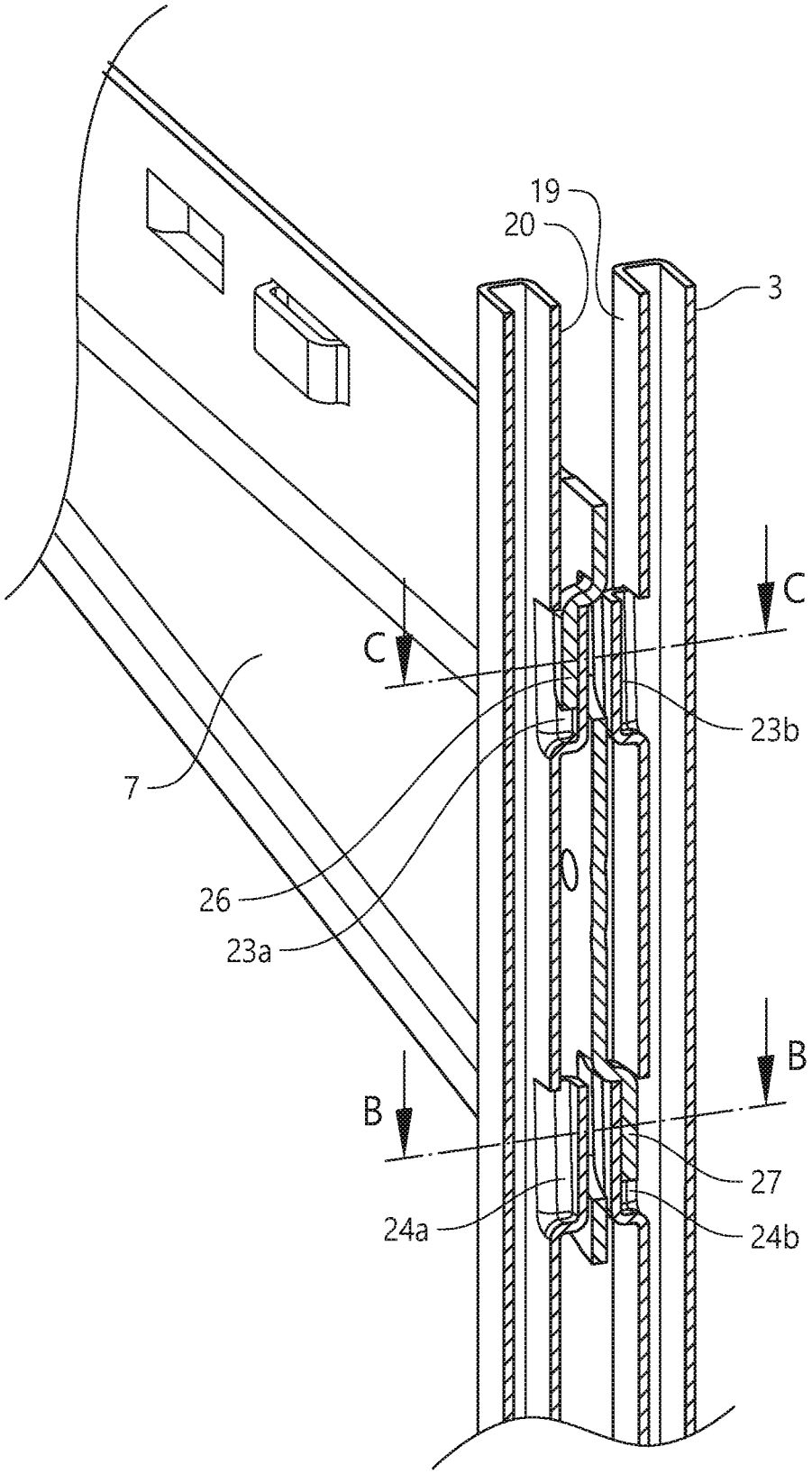
FIG. 9 is a partly cut perspective view of the support bracket and the elongated support member according to FIG. 8 in an engaged state.

FIG. 9 is a partly cut perspective view of the support bracket 7 and the elongated support member 3 according to FIG. 8 in an engaged state. FIGS. 10 and 11 are two cross sectional views of the support bracket 7 and the elongated support member 3 according to FIG. 9 at section C-C and section B-B. It may be noted that a contact surface of the edge 29 of the support bracket 7 contacts a complimentary shaped contact surface of the elongated support member 3 in the mounted state. More specifically, the central portion 53 of the U-shaped elongated support member 3 defines a valley 54 for receipt of the edge 29 of the support bracket 7. The valley 54 extends in the longitudinal direction of the elongated support member. The valley 54 is dimensioned for supporting the bracket 3 on either side in the mounted state. Thus, the central portion 53 comprises wall sections defining the valley, wherein a spacing between two wall sections defining the valley laterally is adapted to be substantially the same as a lateral extension of the bracket 7 at the mounting end 22.

Figure 12:
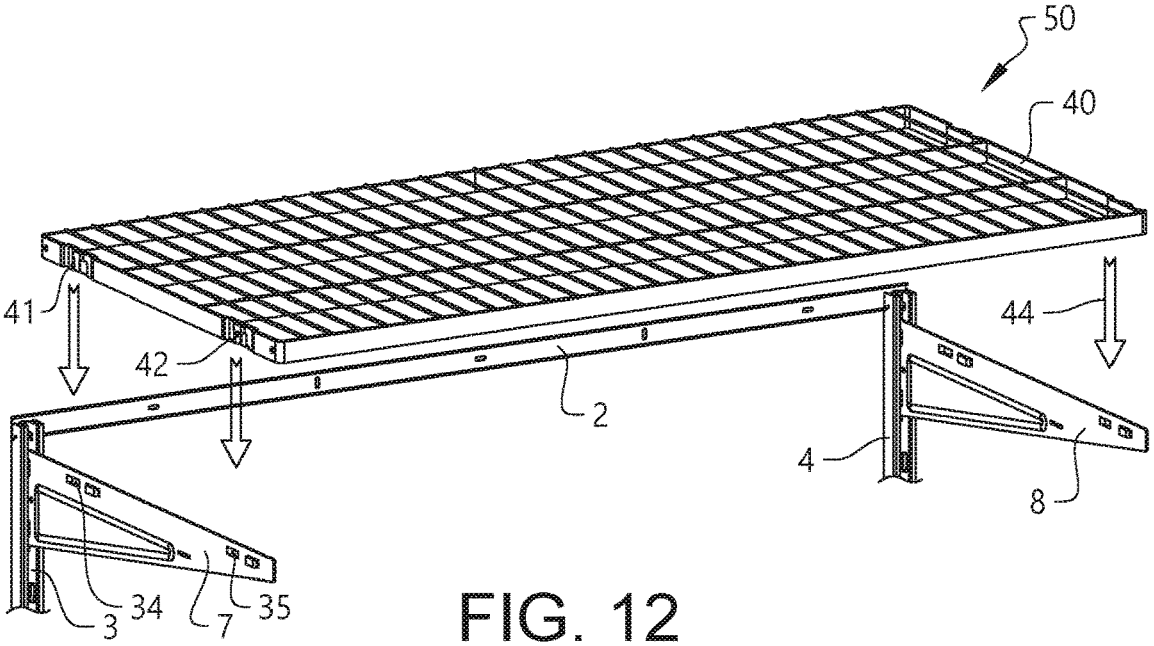
Figure 13:
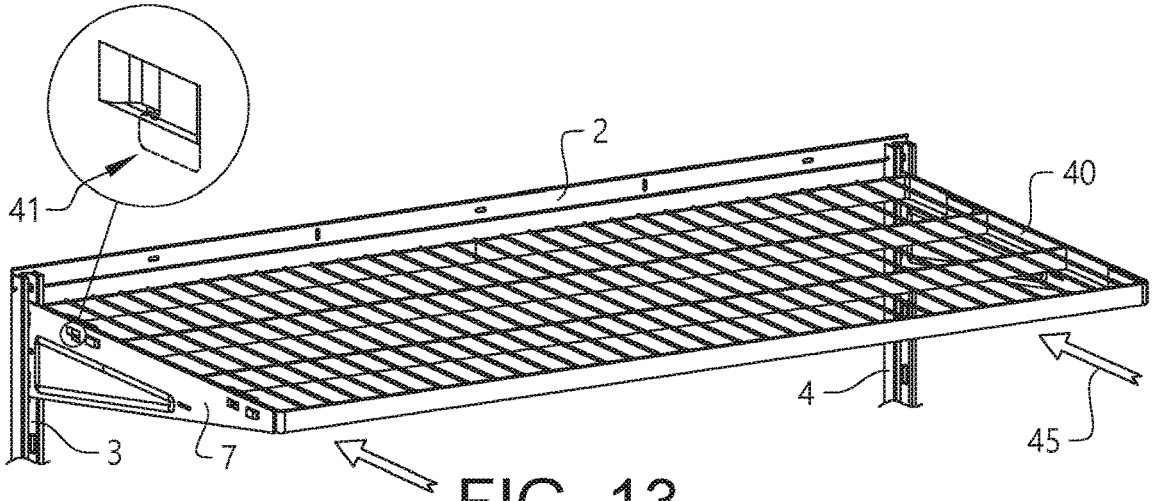
Figure 14:
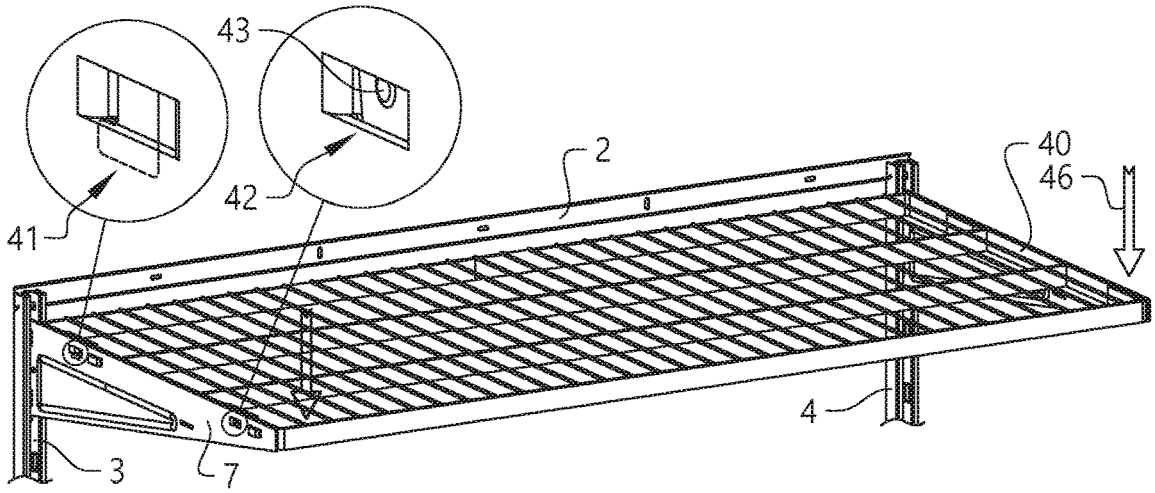

FIG. 12-14 are perspective views of consecutive stages of an assembly procedure for a storage system 50 according to a first embodiment. The assembly procedure comprises mounting a storing arrangement 40 in the form of a shelf to the support brackets 7,8. The shelf 40 has a rectangular plate shape and is formed by a grid. The shelf 40 comprises connection means 41, 42 at each one of its opposite ends facing the brackets 7,8 for engagement with the storing arrangement supporting means 34,35 of the bracket 7 and the corresponding storing arrangement supporting means of the bracket 8. More specifically, the connection means 41, 42 comprises two projections spaced in an extension direction of the associated short side of the shelf. Further, the projections extend perpendicular to a plane defined by the shelf. A first one of the connection means 41 has an L-shape for supporting below a portion of a first one of the storing arrangement supporting means 34 of the bracket 7. A second one of the connection means 42 has a portion 43 projecting in parallel with a main extension direction of the shelf for a snap fit relative to a second one of the storing arrangement supporting means 35 of the bracket 7.

At a first stage of mounting the shelf 40, see FIG. 12, the shelf 40 is lowered from above towards the brackets 7,8, see arrows 44, in a way that the connection means 41,42 at either short side of the shelf engages the storing arrangement supporting means 34,35 of each one of the brackets 7,8. Thus, the shelf 40 is moved in a vertical direction downwards while the shelf is held in a substantially horizontal orientation.

At a second stage of mounting the shelf 40, see FIG. 13, the shelf 40 is pushed horizontally towards the wall in a way that the L-shaped connection means 41 support below a portion of a first one of the storing arrangement supporting means 34 of the bracket 7.

At a third stage of mounting the shelf 40, see FIG. 14, an outer longer side of the shelf 40 is pushed downwards, see arrow 46, so that the snap-fitting means 43 engages its respective storing arrangement supporting means 35 of the bracket 7.

A similar arrangement of connection means (not shown) are provided at the opposite short end of the rectangular shelf for simultaneous engagement with corresponding storing arrangement supporting means of the bracket 8 during the mounting procedure.

Figure 15:
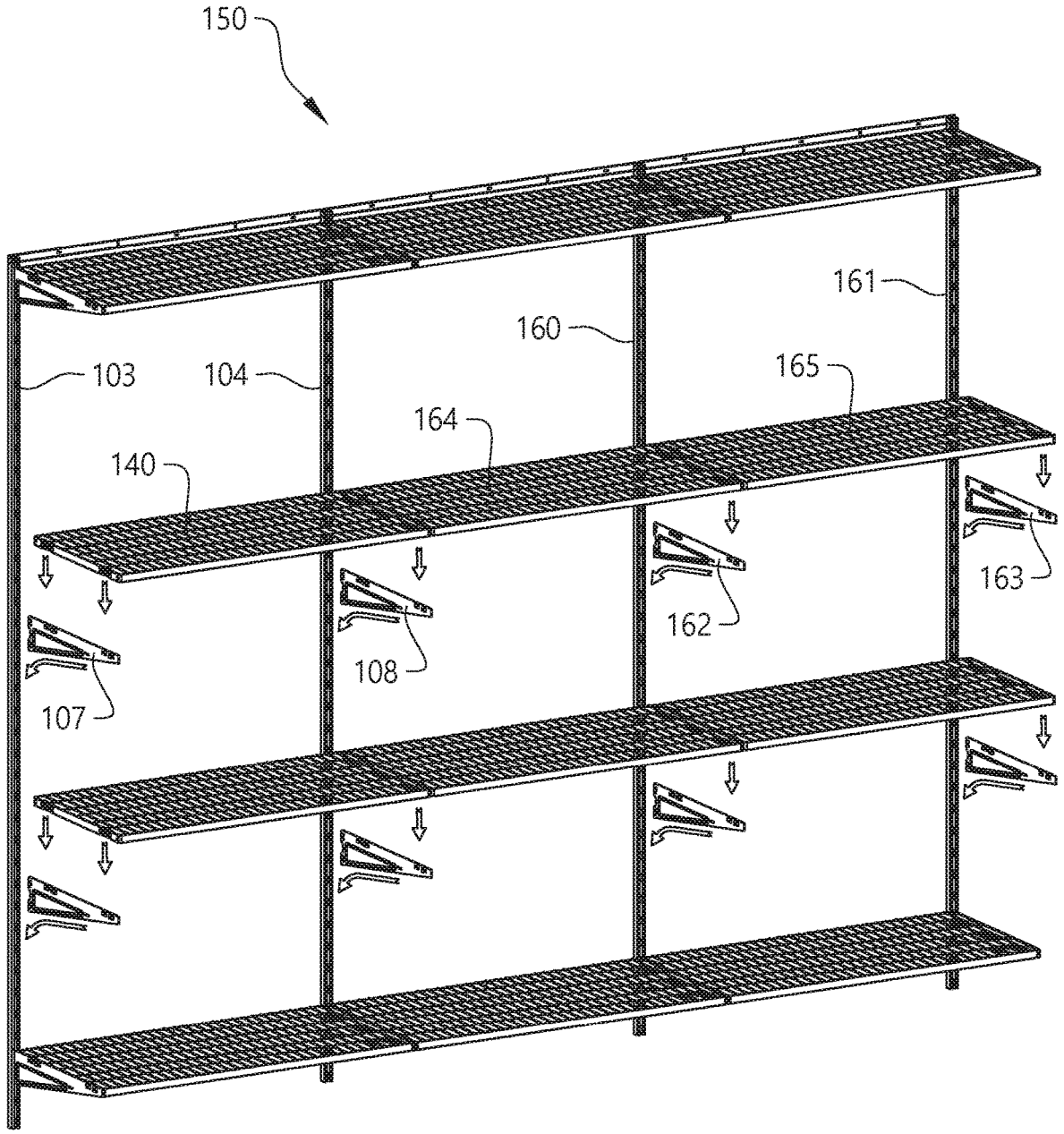
FIG. 15 is a perspective view of a storage system according to a second embodiment, and FIG. 16 are perspective views of a storing arrangement according to different embodiments.

FIG. 15 is a perspective view of a storage system 150 according to a second embodiment. The storage system 150 comprises a crossbar 102 and four elongated support members 103,104,160,161 according to the first embodiment. The elongated support members 103,104,160,161 are arranged with mutual spacing in an extension direction of the cross bar 102. Further, the storage system 150 comprises a plurality of support brackets according to the first embodiment, wherein four brackets 107,108,162,163 are arranged one at each elongated support member 103,104,160,161 and at the same height for supporting three shelves 140,164,165 forming a single support surface for goods or other items. Due to the fact that each one of the brackets 107,108,162,163 has a single wall construction, it occupies a small distance between two adjacent shelves on opposite sides of the bracket. Thus, a total storage surface of the system is optimized and form an almost seamless structure.

Figure 16:
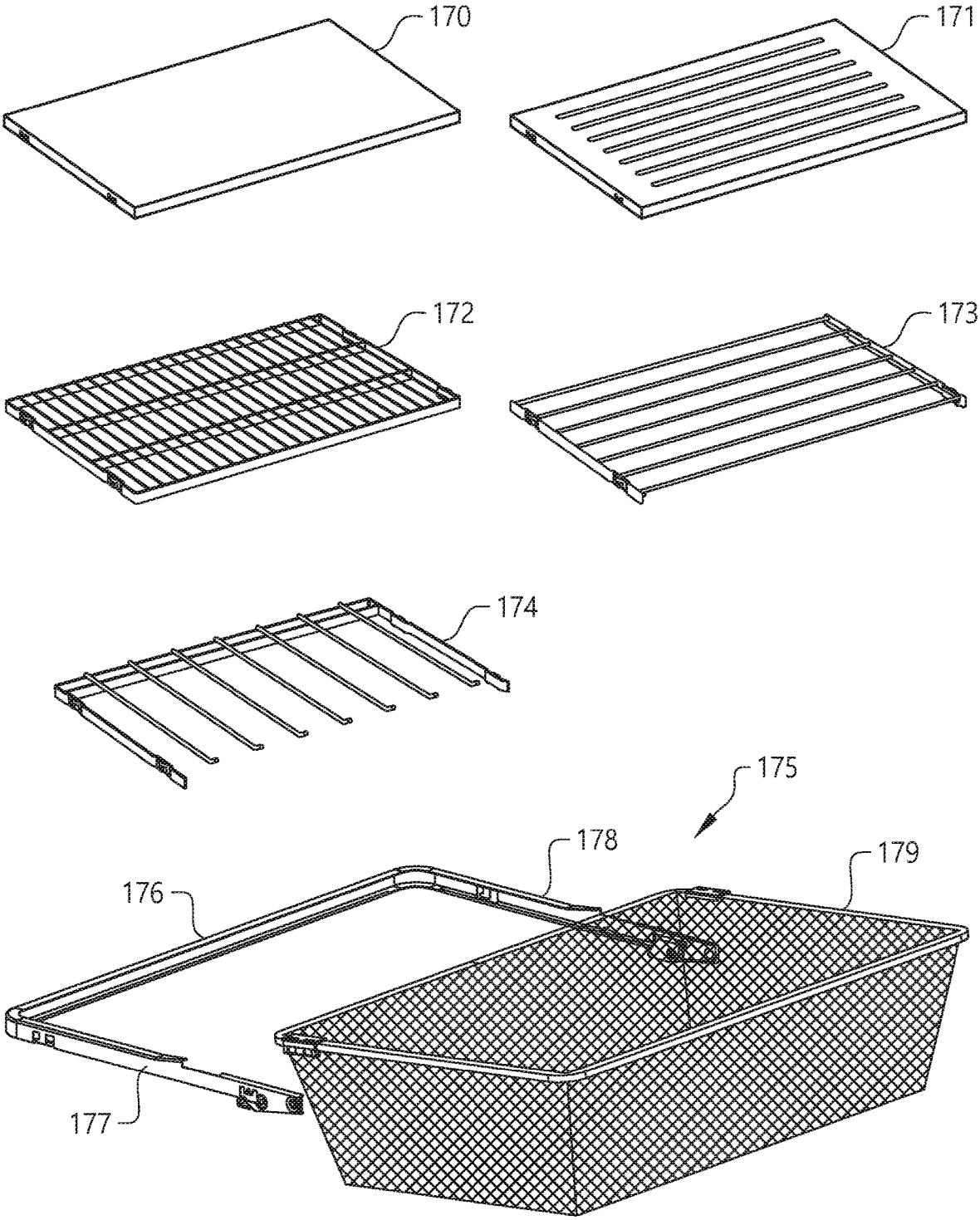

FIG. 16 are perspective views of a storing arrangement according to different embodiments for use in association with the brackets. Each one of the storing arrangements has a generally rectangular shape. According to a first example, a solid shelf 170 in the form of a board is shown. The board may be a wood based panel. Further, an upper main surface of the board has a planar shape. According to a second example, which is a variant of the first example, a solid shelf 171 is provided with a structure on the upper main surface. The structure comprises a plurality of parallel ridges extending in parallel with a main extension direction of the shelf. According to a third example, a shelf 172 is formed by a grid of metallic rods extending perpendicular relative to each other and spaced form each other. According to a third example, a shelf 173 is formed by a plurality of parallel metallic rods extending in parallel with a main extension direction of the shelf. According to a fourth example, a storing arrangement 174 is formed by a plurality of parallel metallic rods extending in parallel with each other and perpendicularly relative to a main extension direction of the storing arrangement. The rods are further spaced from each other in a direction perpendicular to the main extension direction of the storing arrangement. More specifically, the metallic rods are attached at an inner end to a support but are free at an outer end. Such a storing arrangement may be used for supporting trousers or other clothes, which may be folded around a respective one of the rods. According to a fifth example, a storing arrangement 175 comprises a U-shaped support 176 provided with connection means at each leg 177,178 for connection to the respective storing arrangement supporting means of the brackets. Further, the legs 177,178 of the U-shaped support has the shape of rails for guiding edges of a basket 179. Thus, the goods storage system forms a modular system.

It is to be understood that the present invention is not limited to the embodiments described above and illustrated in the drawings; rather, the skilled person will recognize that many changes and modifications may be made within the scope of the appended claims.

According to one variant, the elongated support members may be attached to the crossbar via an intermediate coupling member. According to a further variant, the elongated support members may be attached directly to the wall, wherein the crossbar would be superfluous.

According to a further variant, the elongated support member may not necessarily be provided with multiple pairs of engagement means, wherein each pair is longitudinally spaced from an adjacent pair. Instead, the pattern of two engagement means on opposite wall portions, which are adapted for engagement with two opposite laterally projecting engagement means of a single support bracket and which are spaced in the longitudinal direction of the elongated support member, may be repeated in the longitudinal direction of the elongated support member. In other words, the design of the elongated support member is not limited to a symmetrical design regarding the positions of the engagement means.

According to a further variant, the support bracket and the associated elongated support member may be designed so that the bracket is solely supported by the elongated support member via the engagement means. In other words, the edge of the support bracket may be arranged at a distance from the central portion of the U-shaped elongated support member in the mounted state.

The invention claimed is:

1. An elongated support member comprising a first wall portion and a second wall portion that are arranged in a spaced relationship defining a channel extending in a longitudinal direction of the elongated support member for receipt of an inner mounting end of a support bracket, wherein the first wall portion comprises a first engagement means that has a generally plate-shaped form and forming a first tab and the second wall portion comprises a second engagement means that has a generally plate-shaped form and forming a second tab, wherein each one of the first tab and the second tab projects inwardly into the channel for engagement with a laterally projecting engagement means of the support bracket, wherein each one of the first and second engagement means has an open end facing in a same direction in the longitudinal direction of the elongated support member for receipt of the laterally projecting engagement means of the support bracket during mounting, wherein the first tab forming the first engagement means is formed by a portion partly cut-out from the first wall portion so that a corresponding hole is formed in the first wall portion and folded so that a space between one edge of the first tab and the first wall portion defines the open end and the second tab forming the second engagement means is formed by a portion partly cut-out from the second wall portion so that a corresponding hole is formed in the second wall portion and folded so that a space between one edge of the second tab and the second wall portion defines the open end, wherein the elongated support member comprises a plurality of pairs of the first engagement means and the second engagement means, wherein each pair comprises a first engagement means on the first wall portion defining the channel laterally in a first direction and a second engagement means on the second wall portion defining the channel laterally in a second direction opposite the first direction, and wherein the first engagement means and the second engagement means are arranged at the same position in the longitudinal direction of the elongated support member and wherein the pairs of engagement means are spaced in the longitudinal direction of the support member.

2. The elongated support member according to claim 1, wherein one of the first engagement means and one of the second engagement means, which are adapted for engagement with the two laterally projecting engagement means of the support bracket, are spaced in the longitudinal direction of the elongated support member.

3. The elongated support member according to claim 1, wherein at least one of the first engagement means and the second engagement means comprises an engagement portion extending at an angle relative to a longitudinal direction of the elongated support member for achieving a wedging function during mounting of the support bracket.

4. The elongated support member according to claim 1, wherein the elongated support member has a U-shaped cross section comprising a central portion, wherein the first and second wall portions extend from each end of the central portion and wherein the central portion defines a valley for receipt of an edge of the support bracket.

5. A goods storage system comprising at least one elongated support member for being arranged against a wall with a longitudinal direction in a vertical direction and at least one support bracket, wherein the at least one elongated support member comprises a first wall portion and a second wall portion that are arranged in a spaced relationship defining a channel extending in a longitudinal direction of the elongated support member for receipt of an inner mounting end of the at least one support bracket, wherein the first wall portion comprises a first engagement means that has a generally plate-shaped form and forming a first tab and the second wall portion comprises a second engagement means that has a generally plate-shaped form and forming a second tab, wherein each one of the first tab and the second tab projects inwardly into the channel for engagement with a laterally projecting engagement means of the at least one support bracket, wherein each one of the first and second engagement means has an open end facing in a same direction in the longitudinal direction of the elongated support member for receipt of the laterally projecting engagement means of the at least one support bracket during mounting, wherein the first tab forming the first engagement means is formed by a portion partly cut-out from the first wall portion so that a corresponding hole is formed in the first wall portion and folded so that a space between one edge of the first tab and the first wall portion defines the open end and the second tab forming the second engagement means is formed by a portion partly cut-out from the second wall portion so that a corresponding hole is formed in the second wall portion and folded so that a space between one edge of the second tab and the second wall portion defines the open end, wherein the at least one support bracket comprises a mounting end for being mounted to the elongated support member, wherein the at least one support bracket comprises a plate-shaped element with a first engagement means projecting laterally in a first direction from the plate-shaped element and a second engagement means projecting laterally in a second direction from the plate-shaped element opposite the first direction, wherein the first engagement means and the second engagement means of the at least one support bracket are positioned at the mounting end of the bracket for engagement with the elongated support member, wherein the at least one support bracket is mountable to the elongated support member by means of the laterally projecting engagement means of the at least one support bracket being engaged with the first and second engagement means in the two spaced wall portions of the elongated support member.

6. The goods storage system according to claim 5, wherein at least one of the first engagement means and the second engagement means of the at least one support bracket is formed in one piece with the plate-shaped element.

7. The goods storage system according to claim 5, wherein at least one of the first engagement means and the second engagement means of the at least one support bracket is formed by a portion partly cut-out from the plate-shaped element.

8. The goods storage system according to claim 5, wherein at least one of the first engagement means and the second engagement means of the at least one support bracket has a generally plate-shaped form.

9. The goods storage system according to claim 5, wherein the plate-shaped element comprises an edge that defines opposite main surfaces of the plate-shaped element, wherein the edge is located at the mounting end for facing the elongated support member, wherein the edge defines an extension direction and wherein the first engagement means and the second engagement means of the at least one support bracket are spaced from each other in the extension direction of the edge.

10. The goods storage system according to claim 9, wherein the first engagement means and the second engagement means of the at least one support bracket are spaced from the edge in a direction perpendicular to the extension direction of the edge.

11. The goods storage system according to claim 9, wherein at least one of the first engagement means and the second engagement means of the at least one support bracket comprises an engagement portion extending at an angle relative to the extension direction of the edge for achieving a wedging function during mounting.

12. The goods storage system according to claim 5, wherein the at least one support bracket comprises means for supporting a storing arrangement, wherein the storing arrangement supporting means is projecting laterally from the plate-shaped element.

13. The goods storage system according to claim 12, wherein the at least one support bracket extends between the mounting end and a free end and wherein the storing arrangement supporting means comprises a first set of at least two projections spaced in the bracket extension direction and projecting in the same direction from the at least one support bracket for supporting a first storing arrangement.

14. The goods storage system according to claim 12, wherein the storing arrangement supporting means comprises a first engagement structure projecting in a first direction from the at least on support bracket for supporting a first storing arrangement and a second engagement structure projecting from the at least one support bracket in an opposite direction relative to the first engagement structure for supporting a second storing arrangement.

15. The goods storage system according to claim 6, wherein the system comprises an elongated crossbar for being fixedly arranged against the wall with a longitudinal direction in a horizontal direction and wherein the crossbar and the elongated support member has complimentary shaped coupling means for hanging the elongated support member on the crossbar.

* * * * *